US011305544B2

(12) United States Patent
Gallart del Burgo et al.

(10) Patent No.: US 11,305,544 B2
(45) Date of Patent: Apr. 19, 2022

(54) CLEANING NOZZLES OF A PRINT APPARATUS

(71) Applicant: Hewlett-Packard Development Company, L.P., Spring, TX (US)

(72) Inventors: Adria Gallart del Burgo, Sant Cugat del Valles (ES); Alex Campa Coloma, Sant Cugat del Valles (ES); Maria Isabel Borrell Bayona, Barcelona (ES); Jordi Bas Ferrer, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 42 days.

(21) Appl. No.: 16/959,500

(22) PCT Filed: Jan. 31, 2018

(86) PCT No.: PCT/US2018/016199
§ 371 (c)(1),
(2) Date: Jul. 1, 2020

(87) PCT Pub. No.: WO2019/152016
PCT Pub. Date: Aug. 8, 2019

(65) Prior Publication Data

US 2021/0053348 A1 Feb. 25, 2021

(51) Int. Cl.
*B41J 2/165* (2006.01)

(52) U.S. Cl.
CPC ..... *B41J 2/16538* (2013.01); *B41J 2/16579* (2013.01); *B41J 2002/1657* (2013.01)

(58) Field of Classification Search
CPC ..... B41J 2/16538; B41J 2/16579; B41J 2002/1657
See application file for complete search history.

(56) References Cited

U.S. PATENT DOCUMENTS

| | | | | |
|---|---|---|---|---|
| 6,280,014 | B1 * | 8/2001 | Sharma | B41J 2/16552 347/28 |
| 6,352,334 | B2 | 3/2002 | Fukushima et al. | |
| 2003/0058299 | A1 | 3/2003 | Endo | |
| 2006/0061613 | A1 | 3/2006 | Fienup | |
| 2007/0076047 | A1 | 4/2007 | Katada | |

(Continued)

FOREIGN PATENT DOCUMENTS

| | | |
|---|---|---|
| CN | 1576013 | 2/2005 |
| CN | 101090825 | 12/2007 |

(Continued)

OTHER PUBLICATIONS

Kusakari, T. et al., "Development of "Jet Press 720S" Digital Inkjet Press", Fujifilm Research & Dev., No. 60-2015, Jan. 28, 2015, 5 pp.

*Primary Examiner* — Sharon Polk
(74) *Attorney, Agent, or Firm* — HP Inc. Patent Department

(57) ABSTRACT

There is disclosed a method comprising determining, by a processor, if there are consecutive nozzles of a print apparatus that are occluded by a contaminant; and, when a predetermined number of consecutive nozzles are occluded, automatically triggering a cleaning operation to at least partially remove the contaminant.

15 Claims, 6 Drawing Sheets

(56) References Cited

U.S. PATENT DOCUMENTS

| | | | | |
|---|---|---|---|---|
| 2009/0147038 | A1* | 6/2009 | Tsukada | B41J 2/16579 347/14 |
| 2009/0237443 | A1 | 9/2009 | Miramanda et al. | |
| 2010/0177136 | A1 | 7/2010 | Koase | |
| 2011/0063366 | A1 | 3/2011 | Sato et al. | |
| 2011/0148981 | A1 | 6/2011 | Chee et al. | |

FOREIGN PATENT DOCUMENTS

| | | | | |
|---|---|---|---|---|
| CN | 102161271 | | 8/2011 | |
| CN | 208589464 | | 10/2017 | |
| EP | 0913262 | A1 * | 5/1999 | B41J 2/16544 |
| EP | 1108546 | | 6/2001 | |
| WO | WO-2002096652 | | 12/2002 | |

* cited by examiner

CLEANING NOZZLES OF A PRINT APPARATUS

BACKGROUND

Contaminants may block nozzles of a print apparatus. For example, external particles may become trapped in the nozzles which may prevent the nozzles from functioning correctly.

BRIEF DESCRIPTION OF DRAWINGS

Non-limiting examples will now be described with reference to the accompanying drawings, in which.

DETAILED DESCRIPTION

Figure 1:
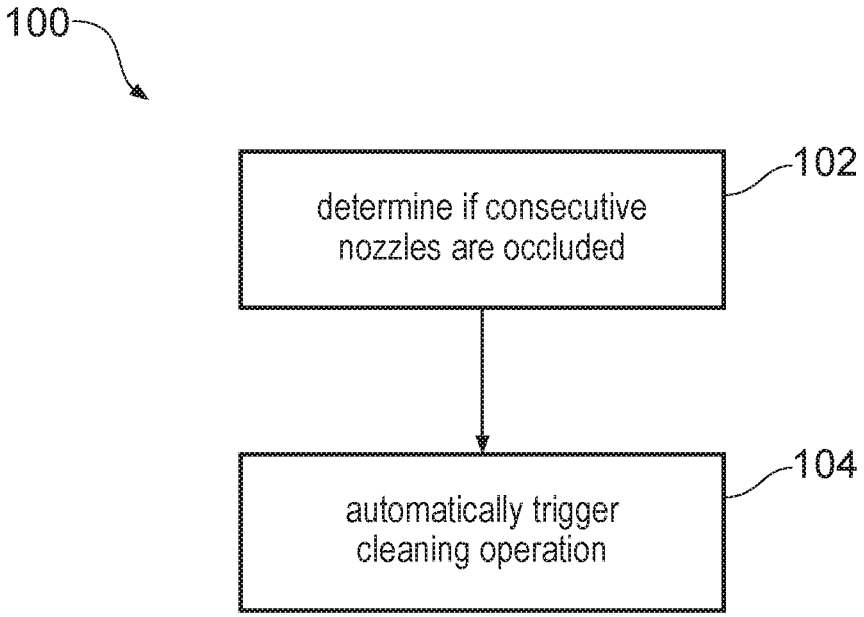
FIG. 1 is a flowchart of an example method of cleaning a nozzle of a print apparatus.

FIG. 1 shows an example flowchart of a method 100 of cleaning a nozzle of a print apparatus, e.g., a 2D printing apparatus or a 3D printing apparatus. The method 100 comprises blocks 102 and 104.

In block 102, a processor determines if consecutive nozzles of a printhead are occluded by a contaminant.

In block 104, when a predetermined number of consecutive nozzles are occluded, a cleaning operation is automatically triggered to at least partially remove the contaminant.

The method 100 may for example use a drop detection test to detect when a nozzle is occluded by a contaminant. Such a drop detection test may be performed during normal printer usage at regular or irregular intervals. The data provided as a result of the drop detection test may then be checked to determine whether consecutive nozzles are at least partially occluded. The method 100 may check data provided by the drop test to determine if consecutive nozzles are occluded within the same row of a nozzle array.

In one example, nozzles are arranged in an array comprising sets of nozzles, wherein each set of nozzles may be arranged in two rows. The nozzles may be identified by number corresponding to their position in a nozzle array. The nozzle array may comprise two rows of nozzles. Odd numbers may denote nozzles in a first row and even numbers may denote nozzles in a second row.

In one example, a drop test may identify that the printhead carriage has ten nozzles occluded by a contaminant. For the sake of example, these ten nozzles may be nozzles: 162, 166, 168, 170, 172, 174, 176, 180, 204, 351. The processor may examine the data for consecutive nozzles. The process may determine that the following consecutive nozzles are occluded: 166, 168, 170, 172, 174, and 176. The consecutive even-numbered nozzles may identify that neighboring nozzles in the same row are occluded by a contaminant. Accordingly, consecutive odd-numbered nozzles may identify that neighboring nozzles in the same row, distinct from the even-numbered nozzle row, are occluded.

Accordingly, the method 100 may trigger a cleaning operation to at least partially remove the contaminant. The cleaning operation may be performed—or at least may possibly be triggered—each time a drop detection is performed and therefore may be performed regularly during the life of a print apparatus.

Contaminants may include external fibers or particles. For example, external particles such as cellulose that may result from cutting a sheet or web may occlude the nozzle of a print apparatus. Contaminants may reside on the surface of the nozzle and the nozzle may be prevented by the contaminant from ejecting a printing fluid, e.g., an ink, or the ability to eject a fluid may be reduced. An external contaminant may also become an internal contaminant, for example an internal fiber or particle. Such a contaminant may get stuck inside a nozzle orifice and may expand when in contact with ink to block the nozzle. Such a contaminant may be removed prior to completely blocking the nozzle.

A nozzle may be firing (e.g. ejecting printing fluid) permanently or semi-permanently. Having a contaminant occluding the nozzle may therefore generate a thermic overstress which may lead to a nozzle failure or ink crusting etc. Once a nozzle is detected as occluded, its job may be taken by another, nearby, healthy nozzle. If several nozzles are detected as blocked then certain nozzles may become overstressed that may cause early life failures. Detecting and removing the contaminant may allow the nozzle to fire correctly and prevent the occurrence of other damage.

Larger particles that block a number of consecutive nozzles may therefore be determined and a cleaning operation may be automatically triggered to remove such larger particles.

Information about where a contaminant, for example an external particle or fiber, has adhered to the nozzles in the printhead may also be obtained. Specific information about where a contaminant is located may also be provided. Accordingly, a specific location of a contaminant may be determined and consecutive nozzles that are occluded may be cleaned.

In one example, the predetermined number of consecutive nozzles to trigger the cleaning operation may be two. Accordingly, the cleaning operation may be triggered when two consecutive nozzles are at least partially occluded. In another example the predetermined number of nozzles to trigger the cleaning operation may be greater than two. For example, the predetermined number may be 10. In this case, the cleaning operation may be triggered when ten consecutive nozzles in a row of nozzles are at least partially occluded. In another example, the cleaning operation may be triggered when a predetermined number of groups of consecutive nozzles are occluded. For example, if two sets of two consecutive nozzles are occluded then the cleaning operation may be triggered. In such an example, the cleaning operation may be triggered when there is a predetermined number of groups of consecutively occluded nozzles (e.g. three groups of two consecutively occluded nozzles). All predetermined numbers may be variable and pre-set. For example, the minimum number of consecutive occluded nozzles to trigger the cleaning operation may be configurable.

Occluded nozzles may have an impact in the resulting image quality. In an example, occluded nozzles may cause white line banding. Banding can be eye-catching to a viewer of a printed image, and therefore a print defect caused by a continuous row of occluded nozzles may adversely affect the perceived image quality. However, by employing the method of FIG. 1, the occurrence of white line banding may be reduced. The number of user interventions carried out to recover from an image quality defect may also be reduced. The occurrence of a return or exchange of a printhead may also be reduced.

A cleaning operation may be more frequent. Accordingly, the cleaning time may be reduced.

The method 100 may further comprise repeating blocks 102 and 104. For example, once a cleaning operation has been triggered in block 104, the method 100 may perform block 102 to determine if consecutive nozzles of a printhead are occluded. When there is a predetermined number of occluded consecutive nozzles, a cleaning operation is automatically triggered to at least partially remove the contaminant.

The method 100 may be performed automatically if the print apparatus is idle for a period of time which may be predetermined.

Figure 2:
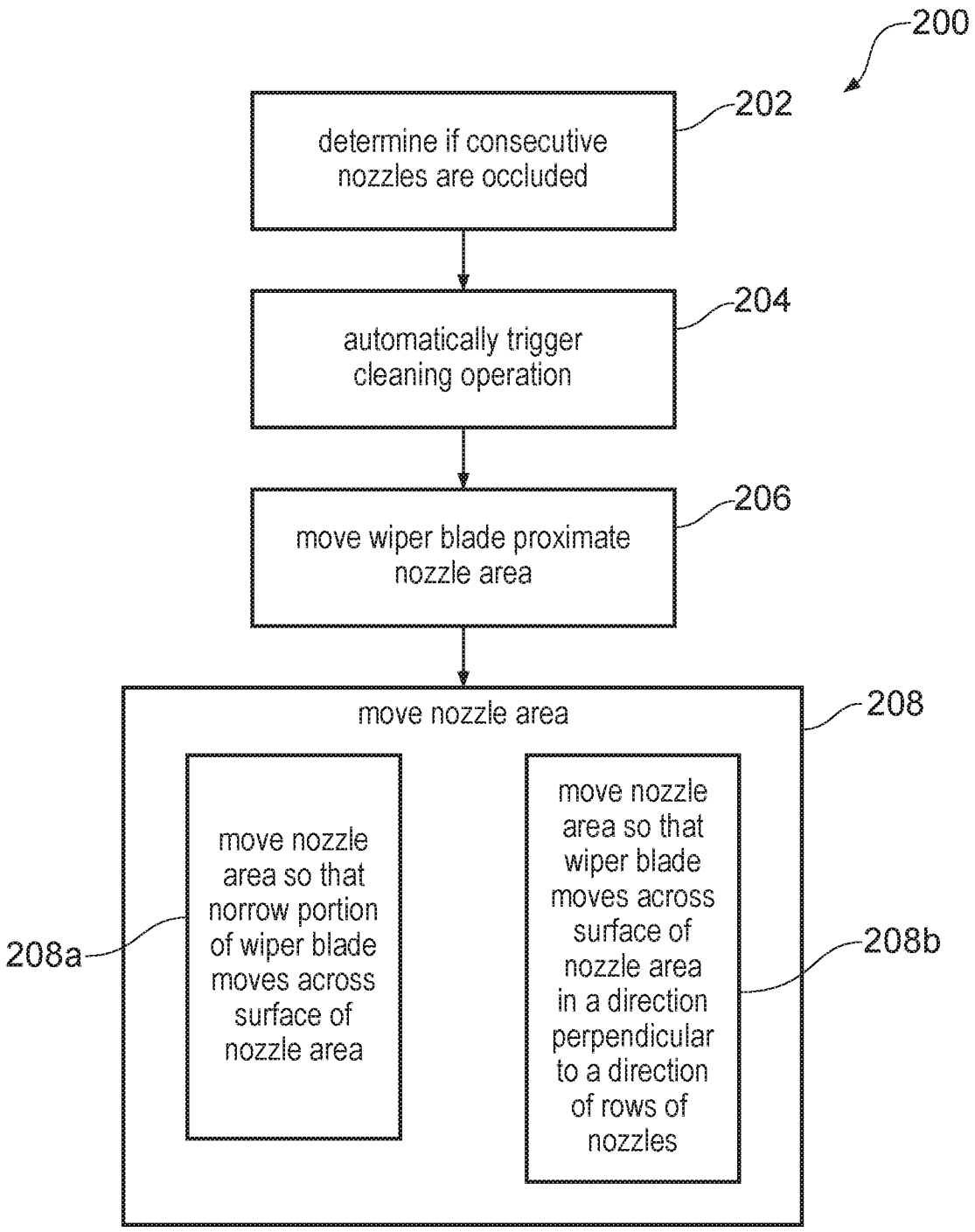
FIG. 2 is a flowchart of a further example method of cleaning a nozzle of a print apparatus.

FIG. 2 shows an example of a method 200 of cleaning a print apparatus. The method comprises blocks 202, 204, 206, and 208.

In block 202, a processor determines if consecutive nozzles of a printhead are occluded.

In block 204, when a predetermined number of consecutive nozzles are occluded, a cleaning operation is automatically triggered to at least partially remove the contaminant.

In block 206, the cleaning operation is triggered and a wiper blade is moved proximate to a nozzle area occluded by the contaminant.

In block 208, the nozzle area is moved so that the wiper blade moves across a surface of the nozzle area. Movement of the nozzle area so that the wiper blade moves across the surface of the nozzle area may at least partially remove the contaminant front the nozzle area. Accordingly, movement of the nozzle area so that the wiper blade moves across the surface of the nozzle area may clean the nozzle area, and the nozzles therein.

The wiper blade may comprise a wide portion and a narrow portion, and, in one example, block 208 may comprise block 208*a*, in which the nozzle area is moved so that the narrow portion of the wiper blade moves across the surface of the nozzle area. Moving the wiper blade proximate the nozzle area may comprise positioning the wiper blade such that the narrower portion of the wiper blade is positioned proximate the nozzle area.

The nozzles may be arranged in a nozzle array, and may be arranged in rows. The nozzles may be arranged in rows and columns. For example, the nozzles may be arranged in an array comprising sets of nozzles, each set of nozzles comprising nozzles arranged in rows and columns.

The nozzles may be arranged in two rows, i.e. arranged in columns where each column may have, e.g., two nozzles. In one example, in block 208 moving the nozzle area so that the wiper blade moves across a surface of the nozzle area may comprise block 208*b* in which the nozzle area is moved so that the wiper blade moves across the surface of the nozzle area in a direction perpendicular to the direction of the rows. In another example, in block 208 moving the nozzle area so that the wiper blade moves across a surface of the nozzle area may comprise blocks 208*a* and 208*b* in which the nozzle area is moved so that a narrow portion of the wiper blade moves across the surface of the nozzle area in a direction perpendicular to the direction of the rows. Accordingly the narrow part of the wiper blade may move across the surface of a first nozzle in the column and then a second nozzle in the column.

A cleaning operation, for example, the cleaning operation comprising blocks 206 and 208, may be repeated. For example, once the nozzle has been moved so that the wiper blade moves across the surface of the nozzle area, the wiper blade may be moved and repositioned proximate another nozzle in the nozzle area to be cleaned and then the nozzle may be moved so that the wiper blade, in its new position, moves across the surface of the nozzle.

The method 200 may repeat blocks 206 and 208 to clean another nozzle or another nozzle area. In one example the method 200 may repeat blocks 202-208, and may repeat blocks 206-208 to check for occluded nozzles and clean the nozzles.

The wiper blade may be part of a movable service station and movement of the wiper blade may be effectuated by movement of the service station. Accordingly the service station may move so that there is relative movement between a nozzle area to be cleaned and the service station to clean the nozzle area, the wiper blade being stationary relative to the surface station.

Figure 3:
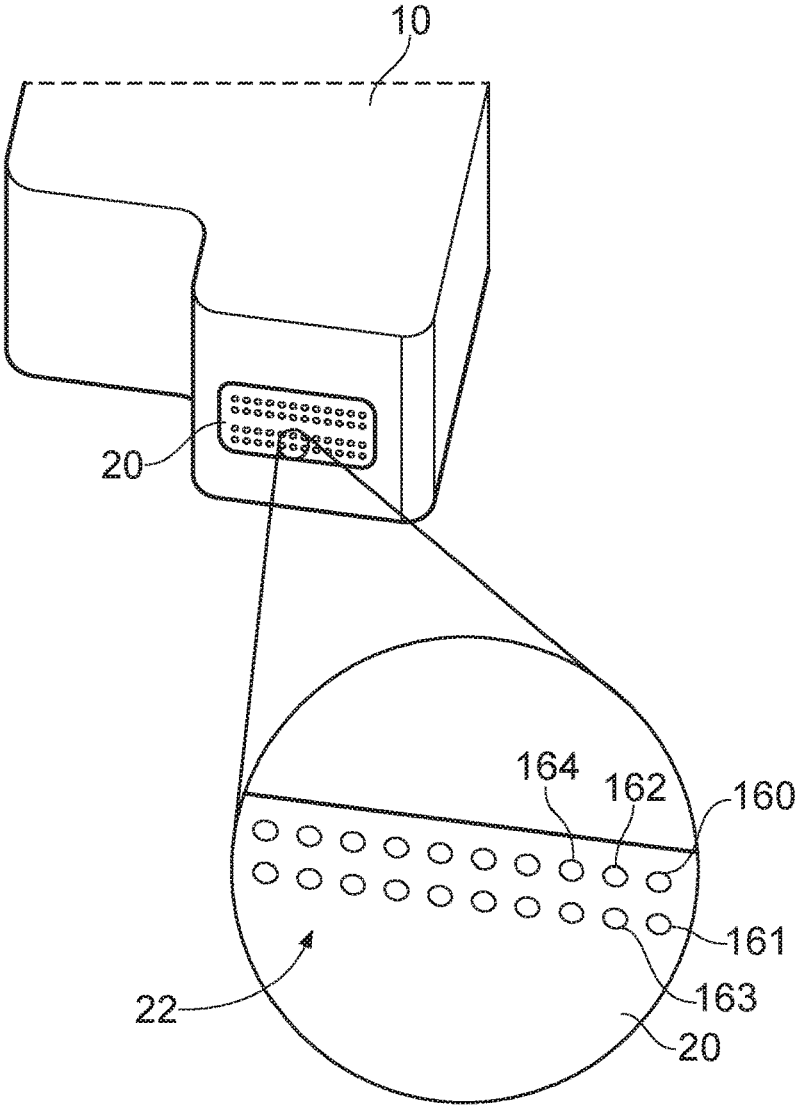
FIG. 3 is a simplified schematic representation of an example printhead.

FIG. 3 shows a schematic representation of an example printhead 10. An underside of the printhead comprises a nozzle plate 20, an enlargement of which is shown in FIG. 3. Nozzle plate 20 comprises nozzles 160, 161, 162, 163, 164 etc. arranged in a nozzle array 22 which comprises two rows of nozzles (or a plurality of columns of nozzles where each column comprises two nozzles). The nozzle array 22 of nozzle plate 20 may comprise a plurality of sets of rows of nozzles. For example, the nozzle array may comprise a plurality of sets of nozzles, each set comprising nozzles arranged in rows, for example each set may comprise nozzles arranged in two rows. Each set in the plurality of sets may correspond to a particular color or ink reservoir in the printhead. For example, a printhead may have three sets of rows of nozzles, each set being associated with a magenta, cyan, and yellow ink reservoir, respectively, in at least one color ink cartridges. In another example, a plurality of rows, or sets of rows, may be associated with a black ink reservoir in at least one black ink cartridges.

Individual nozzles in the nozzle array 22 may be numbered. As shown in FIG. 3 nozzles in one of the two rows may be even-numbered and nozzles in the other row may be odd-numbered. Odd-numbered nozzles such as nozzles 161, 163 may be arranged in a first row, and even-numbered nozzles such as nozzles 160, 162 may be arranged in a second row. Accordingly, if it is identified that consecutive even or odd numbered nozzles are occluded then a method may be triggered to at least partially remove the contaminant.

In one example, if numerical consecutively numbered nozzles, e.g. nozzle 160 and 161, are detected to be occluded then a cleaning operation may be triggered to at least partially remove the contaminant. Therefore, if consecutive nozzles in different rows, but in the same column, are detected then a cleaning operation may be triggered.

Figure 4:
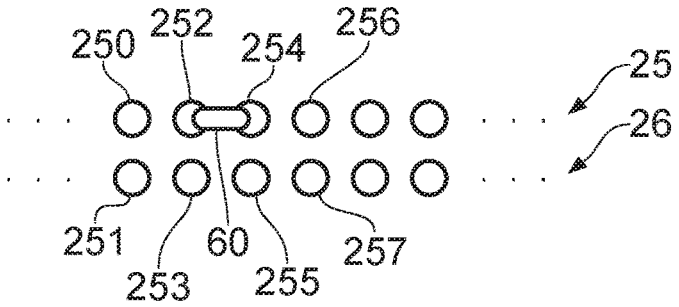
FIG. 4 is a simplified schematic representation of an example nozzle array.

FIG. 4 shows a schematic representation of a nozzle array in a nozzle plate of a printhead. Individual nozzles are arranged in two rows with even-numbered nozzles (e.g. nozzles 250, 252, 254, 256 etc.) arranged in a first row 25 and odd-numbered nozzles (e.g. nozzles 251, 253, 255, 257 etc.) arranged in a second row 26. FIG. 4 illustrates an example where two consecutive nozzles in the same row, consecutive nozzles 252 and 254 in first row 25, are occluded, schematically represented at 60. That the two consecutive nozzles 252 and 254 are occluded by contaminant 60 may be detected and this may trigger a cleaning operation to remove the contaminant 60. In another example, the predetermined number of consecutive nozzles to trigger a cleaning operation may be greater than 2, in which case contaminant 60 may extend across more than two nozzles. In this case, one contaminant particle 60 occludes both nozzles. In other examples, nozzles may be occluded by separate contaminant particles.

Figure 5:
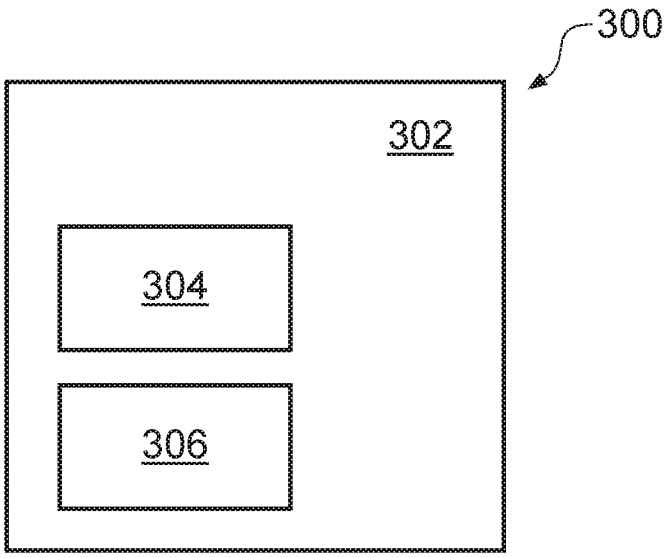
FIG. 5 is a simplified schematic representation of an example print apparatus.

FIG. 5 shows an example of a print apparatus 300. The print apparatus 300 comprises a controller 302. The controller 302 comprises a nozzle monitoring module 304 and a cleaning module 306.

Nozzle monitoring module 304 is to detect if nozzles of a printhead installed in the print apparatus 300 are occluded by a contaminant.

If a continuous row of occluded nozzles above a predetermined size is detected then cleaning module 306 is to trigger a cleaning operation to at least partially remove the contaminant from an area of the continuous row of occluded nozzles.

Figure 6:
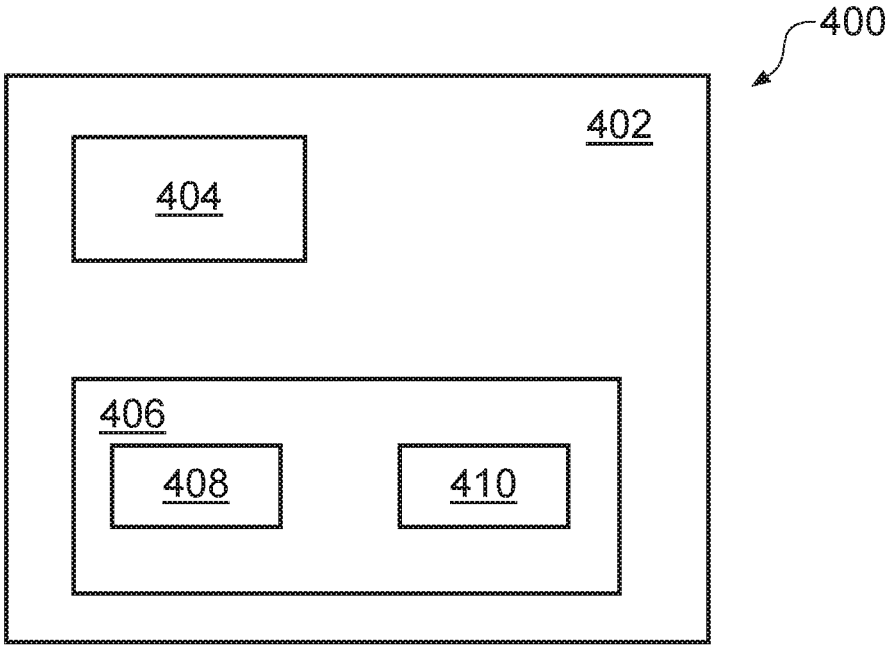
FIG. 6 is a simplified schematic representation of a further example print apparatus.

FIG. 6 shows another example of a print apparatus 400. The print apparatus 400 comprises a controller 402 and the controller comprises a nozzle monitoring module 404 and a cleaning module 406. Cleaning module 406 comprises a wiper moving module 408 and a nozzle moving module 410.

In use of the apparatus 400, the nozzle monitoring module 404 is to detect if nozzles of a printhead installed in the print apparatus 400 are occluded by a contaminant.

If a continuous row of occluded nozzles above a predetermined size is detected then the cleaning module 406 triggers a cleaning operation to at least partially remove the contaminant from an area of the continuous row of occluded nozzles.

In use of the apparatus 400, the wiper moving module 408 may move a wiper to a position proximate a nozzle.

The nozzle moving module 410 is to move the nozzle so that the wiper moves across a surface of the nozzle to clean the area of the continuous row of occluded nozzles.

The wiper may comprise a wide portion and a narrow portion. The nozzle moving module 410 may move the nozzle so that the narrow portion of the wiper moves across a surface of the nozzle to clean the area of the continuous row of occluded nozzles. The nozzle moving module 410 may move the nozzle so that the wiper moves across a surface of the nozzle in a direction perpendicular to the continuous row of occluded nozzles to clean the area of the continuous row of occluded nozzles. Nozzle moving module 410 may move the nozzle so that the narrow portion of the wiper moves across a surface of the nozzle in a direction perpendicular to the continuous row of occluded nozzles to clean the area of the continuous row of occluded nozzles.

Figure 7:
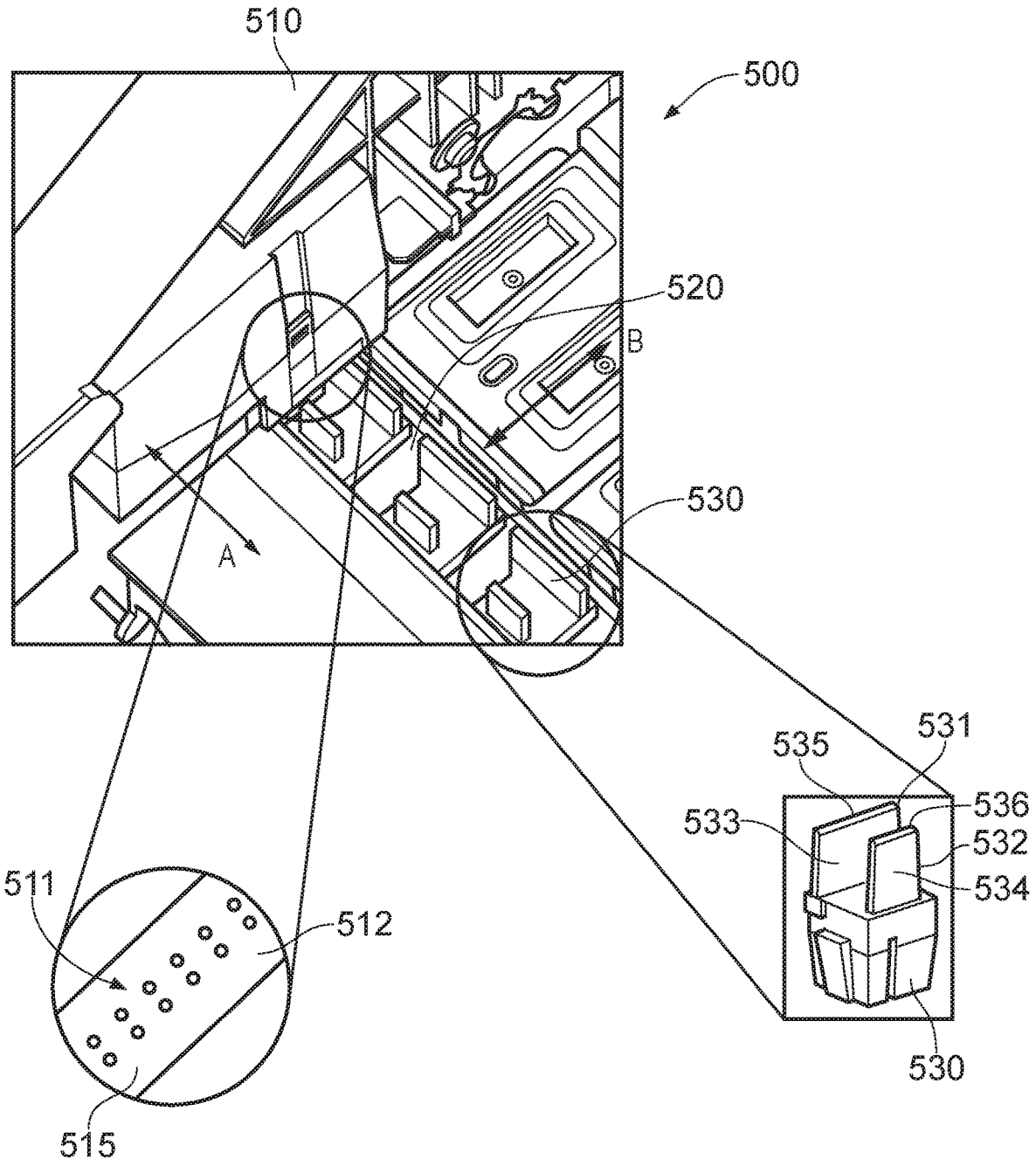
FIG. 7 is a simplified schematic representation of an example print apparatus having a print carriage and a service station.

FIG. 7 shows an example of a print apparatus 500 comprising a print carriage 510 and a wiper moving module, in this example comprising a service station 520. Print carriage 510 may receive at least one printhead.

Service station 520 comprises at least one wiper 530. An enlarged view of wiper 530 is shown in FIG. 7. Wiper 530 comprises wiper blades 531 and 532. Each blade has a wide portion and a narrow portion. For example wiper blade 531 has a wide portion 533 and wiper blade 532 has a wide portion 534. Wiper blade 531 has a narrow portion 535 and wiper blade 532 has a narrow portion 536. The narrow portion of each wiper blade may be a lip or rim formed at a terminal end of the wide portion of the wiper blade. The narrow portion of the wiper blade may be the surface of the blade with the smallest dimensions, for example the smallest length, width or height.

Print carriage 510 comprises a nozzle array 515 located on a nozzle plate 512. Nozzle plate 512 and nozzle array 515 are located on an underside of print carriage 510. An enlarged view of the nozzle array 515 on the underside of the print carriage 510 is shown in FIG. 7. Nozzles 511 are located on the nozzle plate 512.

As shown in FIG. 7 the wiper blades are positioned so that the narrow part of the blade is aligned perpendicularly with the nozzle rows.

Print carriage 510 may be movable. If it is determined that a row of consecutive nozzles in the nozzle array 515 is occluded by a contaminant, a wiper may be moved in the direction of arrow B such that one of the wiper blades of the wiper is positioned proximate one of the nozzles in the nozzle array 515. The nozzle may be moved in the direction of arrow A, by virtue of movement of the print carriage 510 in the direction of A, which will cause the narrow portion of the wiper blade to move across the surface of the nozzle in a direction perpendicular to the rows of nozzles.

Once the wiper is positioned, movement of the carriage 510 in the direction of arrow A, may cause both narrow portions of a wiper, for example narrow portions 535 and 536 of wiper blades 531 and 532 of wiper 530 to each move across a surface of two consecutive nozzles in a row.

Once the carriage 510 has been moved so that the wiper moves across the surface of an occluded nozzle the wiper may be re-aligned, or repositioned, i.e. the wiper may move again in the direction of arrow B, to be positioned proximate another occluded nozzle, or a further area of a row of occluded nozzles. The print carriage 510 may then be moved so that the wiper, for example the narrow part of the wiper blade, moves across the surface of an occluded nozzle in the further area of the row of occluded nozzles.

The print carriage 510 may be moved when the wiper, having itself moved, is stationary, and not while the wiper is moving.

The service station 520 may be movable. The wiper may be integral with the service station 520. The wiper may be attached to or secured to the service station 520. Movement of a wiper may be effected by virtue of movement of the service station 520. For example, movement of the wiper in the direction of arrow B may be by virtue of movement of the service station in the direction of arrow B.

Accordingly, a cleaning operation may comprise an initial movement of the service station 520 followed by a subsequent movement of the print carriage 510. This may cause the nozzle to be wiped in the perpendicular direction of the nozzle array.

The wiper blade may comprise a resiliently deformable material. For example, the wiper blade may comprise rubber. Movement of the wiper blade across the surface of a nozzle may cause the wiper blade to deform slightly in the direction opposing its relative motion. The narrow part of the wiper blade may exhibit greater resilience than the wider part of the wiper blade. Accordingly moving the nozzle so that the narrow part of the wiper blade moves across the surface of a nozzle may cause the narrow part of the wiper blade to deform less than if the wider part of the wiper blade were used.

Figure 8:
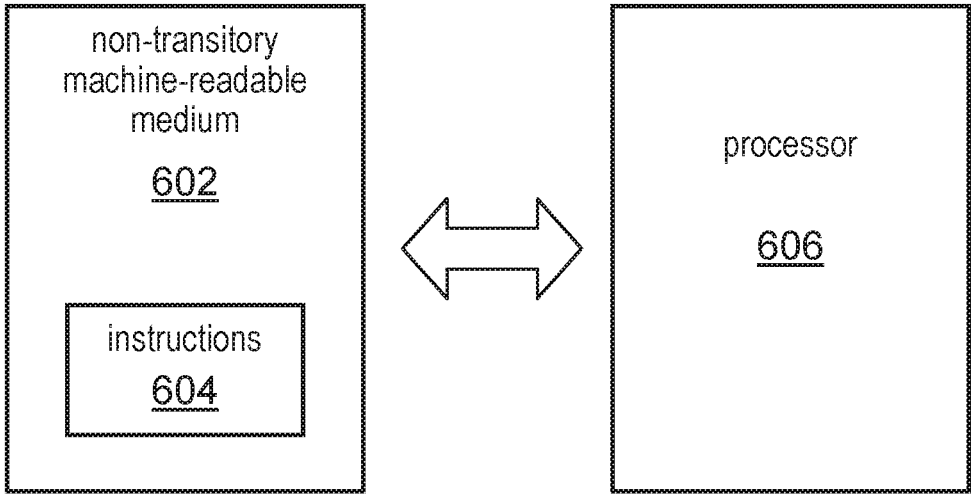
FIG. 8 schematically shows a non-transitory machine-readable medium and a processor.

FIG. 8 shows a non-transitory machine-readable medium 602 encoded with instructions 604 executable by a processor 606, comprising instructions to detect if nozzles of a printhead are at least partially blocked by a contaminant, determine if there are consecutive nozzles that are at least partially blocked, and, if a predetermined amount of consecutive nozzles are at least partially blocked by the contaminant, automatically trigger a cleaning operation to at least partially remove the contaminant.

The non-transitory machine-readable medium 602 encoded with instructions 604 executable by a processor 606 may also comprise instructions to move a wiper blade proximate to a nozzle area comprising the predetermined amount of consecutive at least partially blocked nozzles, and move the nozzle area so that the wiper blade moves across a surface of the nozzle area.

The non-transitory machine-readable medium 602 encoded with instructions 604 executable by a processor 606 may also comprise instructions to move a wiper blade proximate a nozzle area comprising a continuous row of at least partially blocked nozzles, and move the nozzle area so that a narrow portion of the wiper blade moves across a surface of the nozzle area.

The non-transitory machine-readable medium 602 encoded with instructions 604 executable by a processor 606 may also comprise instructions to move a wiper blade proximate a nozzle area of a continuous row of nozzles which are at least partially occluded, and move the nozzle area so that the wiper blade moves across a surface of the nozzle area in a direction perpendicular to the direction of the rows.

The non-transitory machine-readable medium 602 encoded with instructions 604 executable by a processor 606 may also comprise instructions to move a wiper blade proximate a nozzle area of a continuous row of occluded nozzles, and move the nozzle area so that a narrow portion of the wiper blade moves across a surface of the nozzle area in a direction perpendicular to the direction of the rows.

Examples in the present disclosure can be provided as methods, systems or machine readable instructions, such as any combination of instructions and hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer program product, the computer program product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfill the functions of several units recited in the claims.

The features of any dependent claim may be combined with the features of any of the independent claims or other dependent claims.

The invention claimed is:

1. A method comprising:

determining, by a processor, if there are consecutive nozzles within a row of nozzles of a print apparatus that are occluded by a contaminant; and when a predetermined number of consecutive nozzles are occluded, automatically triggering a cleaning operation to at least partially remove the contaminant, wherein the cleaning operation comprises:

moving, along a first axis parallel to the row of nozzles, a wiper blade that is perpendicular to the row of nozzles so that the wiper blade is positioned in-line with just a first nozzle of the consecutive nozzles; and moving, along a second axis perpendicular to the row of nozzles, the row of nozzles so that the wiper blade moves across just the first nozzle of the consecutive nozzles.

2. A method in accordance with claim 1, wherein the cleaning operation further comprises:

moving, along the first axis, the wiper blade so that the wiper blade is positioned in-line with just a second nozzle of the consecutive nozzles; and moving, along the second axis, the row of nozzles so that the wiper blade moves across just the second nozzle of the consecutive nozzles.

3. A method in accordance with claim 2, wherein the cleaning operation further comprises:

moving, along the first axis, the wiper blade so that the wiper blade is positioned in-line with just a third nozzle of the consecutive nozzles; and moving, along the second axis, the row of nozzles so that the wiper blade moves across just the third nozzle of the consecutive nozzles.

4. A method in accordance with claim 1, wherein the row of nozzles is a first row of nozzles, the print apparatus further includes a second row of nozzles, and each nozzle of the first row has a corresponding nozzle of the second row that is in-line with the nozzle of the first row, wherein moving the wiper blade so that the wiper blade is positioned in-line with just the first nozzle of the consecutive nozzles also results in the wiper blade being positioned in-line with just the corresponding nozzle of the second row that is in-line with the first nozzle, and wherein moving the first row of nozzles so that the wiper blade moves across just the first nozzle of the consecutive nozzles also results in moving the second row of nozzles so that the wiper blade moves across just the corresponding nozzle of the second row that is in-line with the first nozzle.

5. A method in accordance with claim 1, wherein the wiper blade is a first wiper blade, wherein moving the first wiper blade so that the wiper blade is positioned in-line with just the first nozzle of the consecutive nozzles also results in a second wiper blade being positioned in-line with just a second nozzle of the row of nozzles, and wherein moving the row of nozzles so that the first wiper blade moves across just the first nozzle of the consecutive nozzles also results in the second wiper blade moving across just the second nozzle of the row of nozzles.

6. A non-transitory machine-readable medium encoded with instructions executable by a processor and comprising instructions to:

detect if nozzles of a printhead are at least partially blocked by a contaminant;

determine if there are consecutive nozzles that are at least partially blocked; and if a predetermined amount of consecutive nozzles within a row of nozzles are at least partially blocked, automatically trigger a cleaning operation to at least partially remove the contaminant, wherein the cleaning operation comprises:

moving, along a first axis parallel to the row of nozzles, a wiper blade that is perpendicular to the row of nozzles so that the wiper blade is positioned in-line with just a first nozzle of the consecutive nozzles; and moving, along a second axis perpendicular to the row of nozzles, the row of nozzles so that the wiper blade moves across just the first nozzle of the consecutive nozzles.

7. A non-transitory machine-readable medium in accordance with claim 6, wherein the cleaning operation further comprises:

moving, along the first axis, the wiper blade so that the wiper blade is positioned in-line with just a second nozzle of the consecutive nozzles; and moving, along the second axis, the row of nozzles so that the wiper blade moves across just the second nozzle of the consecutive nozzles.

8. A non-transitory machine-readable medium in accordance with claim 7, wherein the cleaning operation further comprises:

moving, along the first axis, the wiper blade so that the wiper blade is positioned in-line with just a third nozzle of the consecutive nozzles; and moving, along the second axis, the row of nozzles so that the wiper blade moves across just the third nozzle of the consecutive nozzles.

9. A non-transitory machine-readable medium in accordance with claim 6, wherein the row of nozzles is a first row of nozzles of a print apparatus, the print apparatus further includes a second row of nozzles, and each nozzle of the first row has a corresponding nozzle of the second row that is in-line with the nozzle of the first row, wherein moving the wiper blade so that the wiper blade is positioned in-line with just the first nozzle of the consecutive nozzles also results in the wiper blade being positioned in-line with just the corresponding nozzle of the second row that is in-line with the first nozzle, and wherein moving the first row of nozzles so that the wiper blade moves across just the first nozzle of the consecutive nozzles also results in moving the second row of nozzles so that the wiper blade moves across just the corresponding nozzle of the second row that is in-line with the first nozzle.

10. A non-transitory machine-readable medium in accordance with claim 6, wherein the wiper blade is a first wiper blade, wherein moving the first wiper blade so that the wiper blade is positioned in-line with just the first nozzle of the consecutive nozzles also results in a second wiper blade being positioned in-line with just a second nozzle of the row of nozzles, and wherein moving the row of nozzles so that the first wiper blade moves across just the first nozzle of the consecutive nozzles also results in the second wiper blade moving across just the second nozzle of the row of nozzles.

11. A print apparatus comprising:

a controller, the controller comprising a nozzle monitoring module and a cleaning module, wherein the nozzle monitoring module is to detect if consecutive nozzles of a row of nozzles of a printhead installed in the print apparatus are occluded by a contaminant, and if the consecutive nozzles are detected as being occluded by the contaminant, the cleaning module is to trigger a cleaning operation to at least partially remove the contaminant, wherein the cleaning operation comprises:

moving, along a first axis parallel to the row of nozzles, a wiper blade that is perpendicular to the row of nozzles so that the wiper blade is positioned in-line with just a first nozzle of the consecutive nozzles; and moving, along a second axis perpendicular to the row of nozzles, the row of nozzles so that the wiper blade moves across just the first nozzle of the consecutive nozzles.

12. A print apparatus in accordance with claim 11, wherein the cleaning operation further comprises:

moving, along the first axis, the wiper blade so that the wiper blade is positioned in-line with just a second nozzle of the consecutive nozzles; and moving, along the second axis, the row of nozzles so that the wiper blade moves across just the second nozzle of the consecutive nozzles.

13. A print apparatus in accordance with claim 12, wherein the cleaning operation further comprises:

moving, along the first axis, the wiper blade so that the wiper blade is positioned in-line with just a third nozzle of the consecutive nozzles; and moving, along the second axis, the row of nozzles so that the wiper blade moves across just the third nozzle of the consecutive nozzles.

14. A print apparatus in accordance with claim 11, wherein the row of nozzles is a first row of nozzles, the print apparatus further includes a second row of nozzles, and each nozzle of the first row has a corresponding nozzle of the second row that is in-line with the nozzle of the first row, wherein moving the wiper blade so that the wiper blade is positioned in-line with just the first nozzle of the consecutive nozzles also results in the wiper blade being positioned in-line with just the corresponding nozzle of the second row that is in-line with the first nozzle, and wherein moving the first row of nozzles so that the wiper blade moves across just the first nozzle of the consecutive nozzles also results in moving the second row of nozzles so that the wiper blade moves across just the corresponding nozzle of the second row that is in-line with the first nozzle.

15. A print apparatus in accordance with claim 11, wherein the wiper blade is a first wiper blade, wherein moving the first wiper blade so that the wiper blade is positioned in-line with just the first nozzle of the consecutive nozzles also results in a second wiper blade being positioned in-line with just a second nozzle of the row of nozzles, and wherein moving the row of nozzles so that the first wiper blade moves across just the first nozzle of the consecutive nozzles also results in the second wiper blade moving across just the second nozzle of the row of nozzles.

* * * * *